US006098864A

United States Patent [19]

Fuchs et al.

[11] Patent Number: 6,098,864

[45] Date of Patent: Aug. 8, 2000

[54] APPARATUS FOR TRANSPORTING A RECORDING MEDIUM IN AN ELECTROGRAPHIC PRINTING OR COPYING DEVICE

[75] Inventors: Werner Fuchs, Woerthsee; Christian Selmer; Stefan Brecht, both of Munich; Hans Taubenberger, Gmund, all of Germany

[73] Assignee: Océ Printing Systems GmbH, Poing, Germany

[21] Appl. No.: 09/189,218

[22] Filed: Nov. 10, 1998

[30] Foreign Application Priority Data

Nov. 10, 1997 [DE] Germany ..... 197 49 603

[51] Int. Cl.[7] ..... B65H 20/00

[52] U.S. Cl. ..... 226/187

[58] Field of Search ..... 226/187, 147

[56] References Cited

U.S. PATENT DOCUMENTS

| | | | |
|---|---|---|---|
| 3,525,463 | 6/1968 | Gerfast | 226/187 X |
| 3,550,830 | 12/1970 | Lagogue | 226/187 X |
| 3,800,993 | 4/1974 | Stephens | 226/187 |
| 3,877,627 | 4/1975 | Boase et al. | 226/187 X |
| 3,884,747 | 5/1975 | Soto | 226/187 X |
| 4,252,450 | 2/1981 | Goodman et al. | 226/187 X |
| 4,625,902 | 12/1986 | Billberg | 226/187 X |
| 4,834,277 | 5/1989 | Gomoll et al. | 226/187 X |
| 4,856,770 | 8/1989 | Farlotti | 226/187 X |
| 4,932,577 | 6/1990 | Weiss | 226/187 X |
| 5,129,749 | 7/1992 | Sato | 226/187 X |
| 5,137,223 | 8/1992 | Brandon et al. | 226/187 X |
| 5,775,565 | 7/1998 | Sand | 226/187 |
| 5,913,470 | 6/1999 | Scribner | 226/187 X |

FOREIGN PATENT DOCUMENTS

| | | |
|---|---|---|
| 0 234 589 | 9/1987 | European Pat. Off. . |
| 1 811 203 | 6/1970 | Germany . |
| 39 39 507 | 2/1991 | Germany . |
| WO 95/19929 | 7/1995 | WIPO . |

*Primary Examiner*—Donald P. Walsh
*Assistant Examiner*—Collin A. Webb
*Attorney, Agent, or Firm*—Hill & Simpson

[57] ABSTRACT

An apparatus for transporting a band-shaped recording medium in an electrographic printing or copying device, includes a drive cylinder, a pressure cylinder mounted displaceably relative to the drive cylinder, and a pressure spring effecting a contact pressure of the pressure cylinder on the drive cylinder, wherein the recording medium is transported between the drive cylinder and the pressure cylinder by friction, and the drive cylinder adjoins the recording medium with a contact surface, and wherein the force effect of pressure spring is divided into a first, radial force component acting perpendicularly to the contact surface and a second force component received by a guide face guiding the pressure cylinder.

11 Claims, 3 Drawing Sheets

APPARATUS FOR TRANSPORTING A RECORDING MEDIUM IN AN ELECTROGRAPHIC PRINTING OR COPYING DEVICE

BACKGROUND OF THE INVENTION

1. Field of the Invention

The present invention relates to an apparatus for transporting a recording medium in an electrographic printing or copying device.

2. Description of the Related Art

In printing and copying devices, the recording medium is transported along a printing station and printed there. The recording medium consists of paper, plastic foil material or other materials according to need. In the transfer printing station of such devices, the recording medium is printed over a defined width.

According to the embodiment of the printing device, Leporello paper, rolled products with perforations or rolled products without perforations can be printed. All types of paper are used for printing. In many instances, what is known as Leporello paper with lateral perforations is used. The transport and guiding therein ensues with driven tractor wheels which engage in the lateral transport holes of the paper. However, rolled papers without perforation are increasingly being used, these necessitating a tractorless drive mechanism.

Published PCT Patent Application No. WO-95/19929 teaches a printer which can process rolled paper both with and without perforations. The drive is therein accomplished by a tractorless friction drive. A first feed edge which prescribes the lateral position of the paper is provided in this device for exact guidance of the paper. Stabilization rollers, a vacuum brake and a roller arrangement with a loop draw are further provided in the device.

Additional measures have proven necessary for a precise, tractorless transport, particularly when relatively light recording media, or paper types, are to be transported.

Furthermore, in drive assemblies in printers it is occasionally necessary to stop the paper transport. In the continuation of the printing process, it is then required that the position of the recording medium is held, or located again with optimal precision. A particular demand arises if the drive mechanism must be swivelled away from the transfer printing station for service purposes, e.g. given breakage of the wire of the corona device located at the transfer printing station. A print job often must be restarted in such a case; i.e., pages which were already printed must be reprinted. Superfluous or duplicate pages thus are printed which must be disposed of (resulting in what is known as spoilage).

SUMMARY OF THE INVENTION

It is thus an object of the present invention to improve a tractorless drive mechanism in an electrographic printer to the effect that the positioning of the recording medium in the transport direction can ensue with optimal precision.

It is a particular object of the invention to reposition the recording medium following a print stoppage or a service action at the drive assembly so precisely that the print process can be continued with optimally little spoilage.

These objects are achieved by an apparatus for the transport of a band-shaped recording medium in an electrographic printing or copying device, including a drive cylinder, a pressure cylinder displaceably mounted relative to the drive cylinder and a pressure spring effecting a contact pressure of the pressure cylinder on the drive cylinder, wherein the recording medium is transported between the drive cylinder and the pressure cylinder by friction, the drive cylinder lies adjacent at the recording medium with a contact surface, and the effective force of the pressure spring is divided into a first, radial force component acting perpendicularly to the contact surface and a second force component received by a guide face guiding the pressure cylinder.

Advantageous embodiments of the invention provide that the second force portion acts in the transport direction of the recording medium.

Preferably, the pressure spring and the drive for the transport cylinder are matched such that in a withdrawal motion of the recording medium opposite the transport direction the second force portion is greater than the frictional force acting on the pressure cylinder from the recording medium. The force direction of the pressure spring forms an acute angle $\chi$ with the connecting line between the drive cylinder and pressure cylinder. A first loop draw with a spring is provided, and that the spring force $F_f$ of the pressure spring, the drive motor and the drive control are matched with one another such that the following applies:

$F_t > F_{dyn}$, whereby $$F_t = F_r \sin \chi,$$
$$F_f = F_r \cos \chi,$$

$$F_r > \frac{F_{SZ}}{\mu_{12}}$$

$$F_{dyn} = \frac{\theta_g \cdot \dot{\omega}}{r}$$

$F_{SZ}$=maximal force of the loop draw spring, $\mu_{12}$=coefficient of sliding friction between drive cylinder and recording medium, $\theta_g$=mass moment of inertia of the pressure cylinder about its rotational axle, $\dot{\omega}$=maximal angular acceleration of the drive cylinder in the withdrawal motion and r=outer radius of the pressure roller.

The apparatus has a pressure roller which is led in a guide slot at a guide face, the guide axle thereof standing at an acute angle to the contact surface. A guide body bearing the rotational axle of the pressure shaft is provided in the guide slot, this body being narrower than the guide slot, whereby the guide body adjoins at the guide face.

A plurality of pressure rollers which press at the drive cylinder are provided along the axis thereof. Two springs are provided per pressure cylinder, these acting symmetrically on the pressure roller via a bearing axle.

A transport apparatus for a band-shaped recording medium encompassing a drive cylinder, a pressure cylinder mounted displaceably relative to the drive cylinder, and a pressure spring effecting pressing of the pressure cylinder onto the drive cylinder are provided in an electrographic printing or copying device. The recording medium is therein transported between the drive cylinder and the pressure cylinder by means of friction; the pressure cylinder lies adjacent at the recording medium with a contact surface. The force effect of the pressure cylinder is split into a first, radial force component acting perpendicularly to the contact surface and a second force component received by a guide face guiding the pressure cylinder.

While the first, radial force portion essentially serves for the avoidance of slippage between the drive cylinder and the recording medium, i.e. for frictional transport, the second force portion can be used for stabilization of the guidance properties of the pressure cylinder, particularly if this force portion acts essentially in the transport direction of the recording medium. The pressure cylinder and the drive for the transport cylinder are therein matched particularly such that in a backward motion of the recording medium against the transport direction the second force portion is greater than the frictional force acting on the pressure cylinder from the recording medium.

With the second force portion it is achieved that the position of the pressure cylinder relative to the drive cylinder remains highly exact given a withdrawal of the recording medium against the transport direction of the print operation. It is thereby avoided that the recording medium is conveyed at a slant when moved in a backward transport direction and thus the recording medium does not deviate from its lateral position.

Such withdrawal is particularly appropriate following a print stoppage in order to give the drive components (such as the motor and sensor) the opportunity to re-synchronize, or respectively, to enable a stable drive condition from the first print character on.

In a preferred embodiment of the invention, the force direction of the pressure spring forms an acute angle with the connecting line between the centers of rotation of the drive cylinder and the pressure cylinder. The pressure cylinder is therein led in a guide slot at a guide face, the guiding axles thereof standing at an acute angle to the normals of the contact surface. A guide body bearing the rotational axle of the pressure shaft can be therein provided in the guide slot, this guide body being narrower than the guide slot, whereby it lies adjacent at the guide face.

A plurality of pressure cylinders can be provided along the drive axle of the transport cylinder, these pressing at the drive cylinder in order to distribute the force of the contact pressure evenly over the width of the recording medium. A plurality of springs—exactly two, in particular—can be provided per pressure cylinder, these acting symmetrically on the pressure cylinder via a pressure axle.

BRIEF DESCRIPTION OF THE DRAWINGS

Exemplifying embodiments of the invention are detailed below with the aid of the figures.

DETAILED DESCRIPTION OF THE PREFERRED EMBODIMENTS

Figure 1:
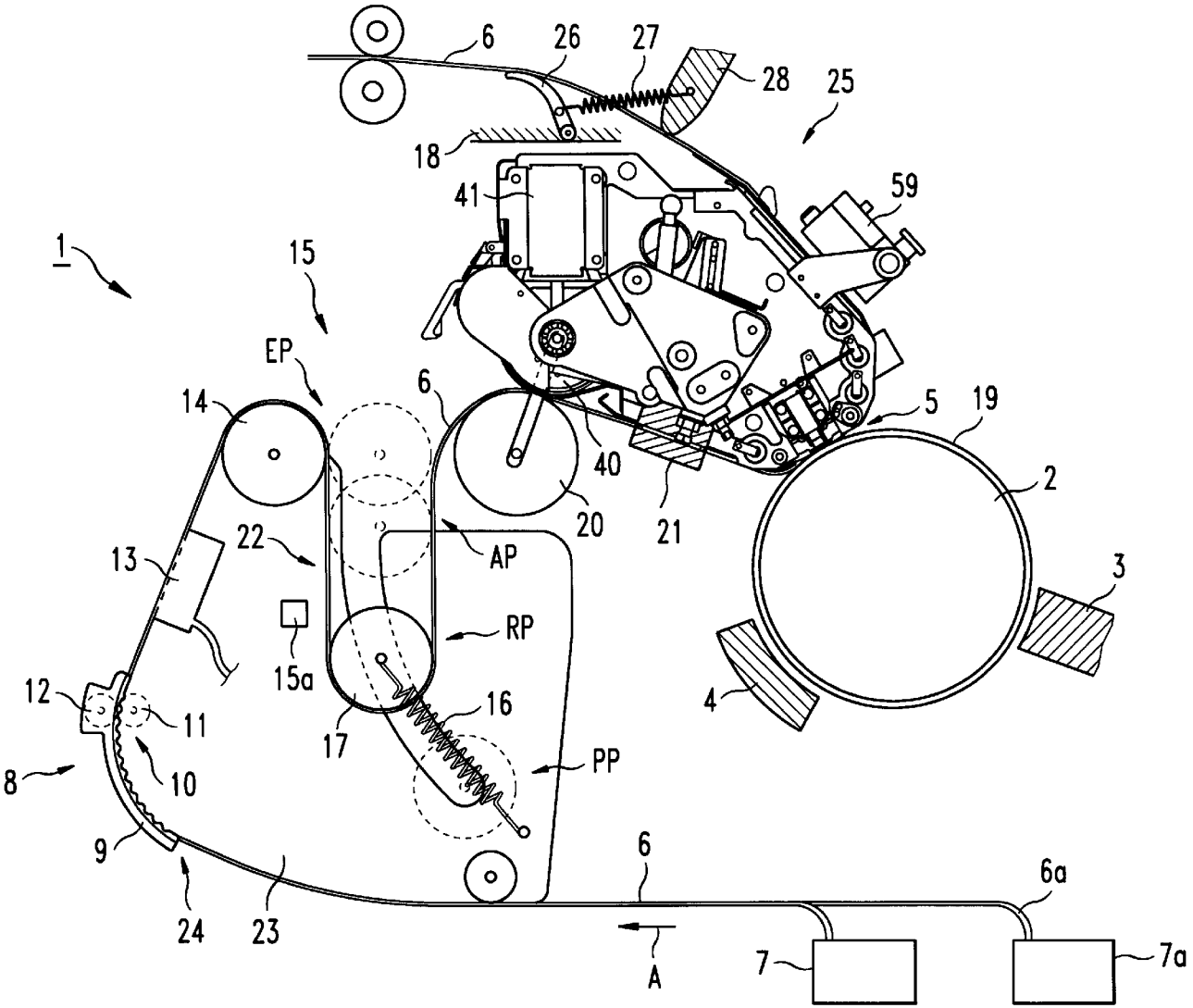
FIG. 1 is a schematic diagram showing the paper flow within an electrophotographic printer.

A paper transport 1 of an electrophotographic printer in FIG. 1 conveys a paper web 6 from a paper supply 7 to a printing transfer station 5 via a pre-centering apparatus 8 and a drive assembly 25. The paper receives toner there from a surface 19 of a photoconductor drum 2, this toner having been applied on the photoconductive drum 2 in a developing station 4. The information transmitted therein corresponds to the latent image information written on the photoconductive drum 2 by means of a character generator 3.

The paper transport as a whole corresponds to the arrangement described in Printed PCT Patent Application No. WO 95/19929. The contents thereof are hereby incorporated into the present application by reference.

In the precentering apparatus 8, the paper web is deflected approximately 90° in the region of a limit stop sheet 9. This region forms a deflection path 24. The paper web is therein fed through between a roller arrangement 10, whereby not only lower rollers 11 but also the upper rollers 12 are set at a slant relative to the paper transport direction A, so that with their rotational motion the rollers exert a force perpendicular to the web transport direction A of the paper web 6. The paper web 6 is thereby pressed against the limit stop sheet 9, thus guaranteeing a sufficiently exact guidance. The upper rollers 12 are mounted at the common profile carrier 23 particularly such that they can be swivelled out, so that a new paper web can be easily inserted between the rollers 11 and 12.

The paper web 6 passes through a paper brake 13 subsequent to the pre-centering in the deflection path 24. The braking effect thereof is based on a vacuum by means of which the paper web 6 is drawn to a vacuum chamber and thus braked. A tension is generated in the paper web 6 by this braking.

The paper web 6 is subsequently fed from a deflection roller 6 to a first loop forming apparatus 15. The loop forming apparatus 15 essentially consists of a flexibly mounted roller 17 which is pulled against the paper tension by a spring 16. A paper supply loop 22 thereby arises. The roller 17 can be moved up, or respectively, down along a direction C by the swivel arm 17*a*. The paper web surrounds the roller 17 by approximately 180 degrees, whereby it is stabilized perpendicularly to the transport direction. The roller 17 is constructed of light materials. Its core consists of rigid material, particularly of carbon-fiber-reinforced plastic (CFK), in order to minimize elastic spring effects within the roller 17. The loop draw 15 and the vacuum brake 13 form a control system which generates a constant tension of the paper web 6 from the vacuum brake 13 to the drive cylinder 40. Magnetically resistive sensors 15*a* therein scan the position of the roller 17. The roller 17 is held optimally constant in a working position AP during the print operation. The spring 16 has an exactly defined working region in a narrow region. The sensors 15*a* are high-resolution with respect to this region about the working point AP, having eight measuring points. Optimally, the vacuum in the brake 13 is then set such that the roller position deviates little from its target position.

For inserting a new paper web 6, the roller 17 is located in an upper insertion position EP. During a print stoppage (e.g. if the drive assembly 25 is swivelled out from the photoconductor drum) the roller 17 is located in the withdraw position RP, whereby the loop 22 is larger than in the working position AP. If the paper web 6 tears, then the roller 17 moves into the lower position PP. One of the sensors 15*a* detects this event and delivers a corresponding error message to the system controller.

After the loop forming apparatus 15, the paper web 6 is fed to the drive assembly 25. A drive cylinder 40 at the input side advances the paper web 6 in the direction of the printing transfer station 5. The drive cylinder 40 is driven by the step motor 41 via a belt. It transfers the driving force to the recording medium 6 by means of friction (to provide frictional driving). A plurality of pressure cylinders 20 additionally presses the paper web 6 against the drive cylinder 40. Before the paper web 6 reaches the printing transfer station 5, it is opto-electronically scanned with a paper width sensor 21.

After the paper web 6 has passed through the printing transfer station 5, it is fed to a second loop forming apparatus 26 by the drive assembly 25. The loop forming apparatus 26 holds the paper web 5 under tension by means of the tension of a spring 27 mounted at a projection 28 of the printer housing 18. After passing the second loop forming apparatus 26, the paper web 6 can be fed to other assemblies, e.g. to a fixing means of the type which is known in which the toner image is fixed on the paper web 6.

The exemplifying embodiment just described is based on the assumption that only one paper web is transported through the printing transfer station 5. In another exemplifying embodiment, it can be just as well provided that two adjacent paper webs 6 and 6*a* are simultaneously transported through the printing transfer station. The second paper web 6*a* would therein derive from a second paper supply 7*a*. All the paper guidance and transport elements as well as the printing transfer station and the photoconductor drum 2 would be adapted with respect to their geometric dimensions such that the two paper webs could pass through the printing transfer station adjacent one another. The arrangement of the paper web and of the transport directions can therein ensue as in Published PCT Application No. WO 96/03282A1.

The paper transport direction is referenced A to be consistent with the figures below. The other reference characters are also maintained inasmuch as the same or structurally identical elements are involved in the description of figures below.

The paper web 5 is fed to the printing transfer station 5 such that the toner image transmitted there is transmitted to the prescribed spot on the paper without loss of information (e.g. without smudging). The drive assembly 25 must function without slippage to the greatest extent possible; i.e., there must be a clear connection between the angle of rotation of the drive cylinder 40, or respectively, the step rate of the step motor 41 and the feed length effected thereby on the paper web 5. It is also thereby achieved in continuous operation that printed marks which are used for cutting the paper web in the post-processing of the printed pages, for example, prescribe the exact page length. Lastly, precise printing in preprinted forms is also possible with such precise driving. In the present drive assembly, a mark located on the paper is scanned with a mark sensor 59 for this purpose, and this information is utilized for controlling of the step motor 41. Further details of this control can be derived from the application with the applicants internal file number 97 1105 DE, filed by the applicant together with the present patent application on the same day.

Figure 3:
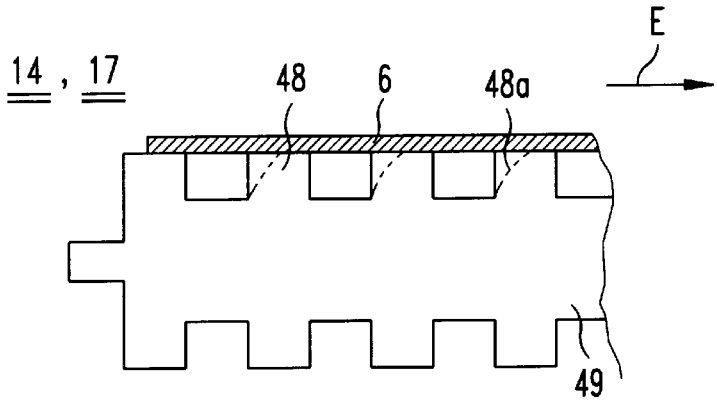
FIG. 3 is a longitudinal section through a deflection roller.

In the frictional conveyance of web-shaped recording media, particular care must be taken that the recording medium is not impermissibly deformed. If longitudinal creases form due to instabilities within the transport web, these are ironed flat between the pressure cylinder 20 and the drive cylinder 40, rendering the resulting sheets unusable. With the described paper transport apparatus 1, this is particularly prevented in that the paper web does not comprise any lateral guide elements in the region of the drive cylinder 40. The web is stabilized particularly by means of the loop forming apparatus 15 and by the structure of the deflection rollers 14, 14*a* and 14*b* (FIG. 3).

The loop forming apparatus 15 generates a constant tension in the paper web 6 during the continuous print operation. The paper web 6 is thus fed to the drive assembly 5 with high constancy of the conveyance direction and of the tension. The degree of tension can therein depend on parameters of the paper web, e.g. on its weight.

Figure 4:
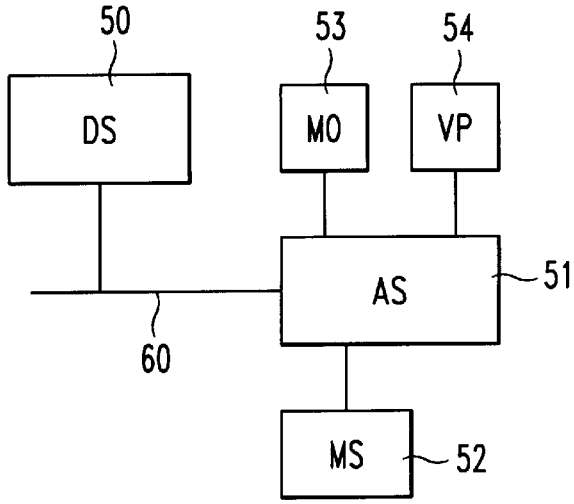
FIG. 4 is a block diagram of an electronic controller.

In the continuous print operation, the drive control 51 depicted in FIG. 4 provides for a constant paper tension. It receives the position signals of the deflection roller 17 of the loop forming apparatus 15 delivered by the sensor 15*a* via its electronics unit 52. From these signals it calculates a required vacuum for the vacuum brake 13 and correspondingly actuates the vacuum pump 54 of the vacuum brake 13. The roller 17 of the loop draw 15 is, thus, held in the working position AP during the print operation.

To execute a print stoppage, the printer control 50 actuates the recording components 2, 3, 4 and the drive control 51 such that the printing is ended precisely at the end of a page. The drive control 51 subsequently actuates the electronics unit 53 of the motor 41 such that the paper web moves a prescribed distance backwards, i.e. opposite the recording direction A. The paper web 6 is therein intermediately stored in the region of the loop draw 15, whereby the deflection roller 17 moves in the withdrawal position RP. The paper web 6 therein forms a loop 22.

The electronic control components and the data bus 60 connecting the printer control 50 to various printer assemblies are depicted in FIG. 4.

During the withdrawal motion of the recording medium web, the paper is held in place by the vacuum brake 13 in the region thereof.

Figure 2:
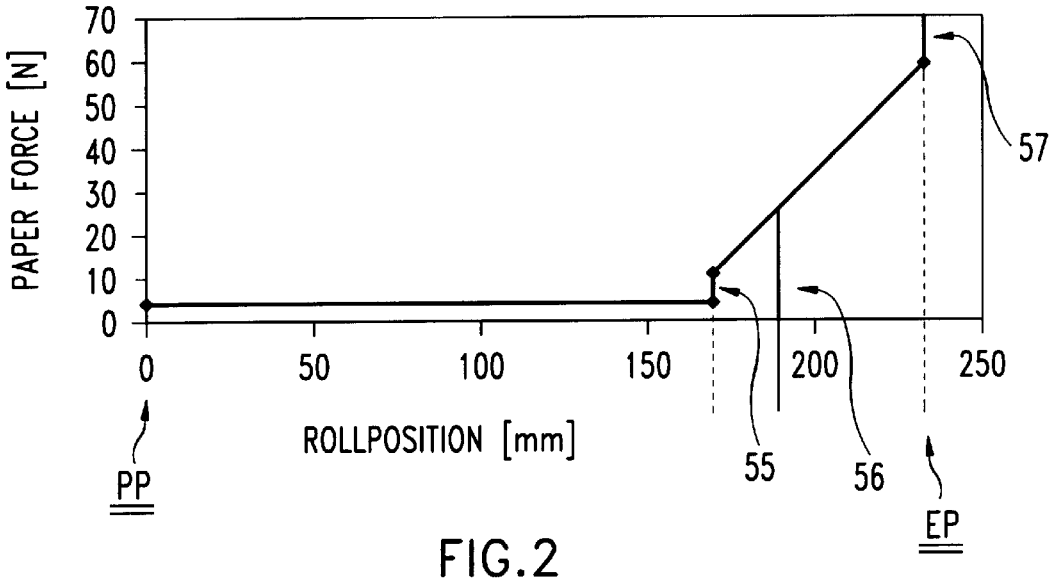
FIG. 2 is a graph showing the force characteristic of a loop draw spring.

FIG. 2 depicts the spring characteristic of the spring 16 of the loop forming apparatus 15. Proceeding from the paper tear position PP, the spring does not exert any force on the deflection roller 17 until a preloading point 55 at which the spring power rises to approximately 10 N. In this region, only the roller 17 exerts its weight on the paper web. Due to the light construction of the roller 17, overswinging is prevented when the roller 17 is moved into the working position. In the exemplifying embodiment depicted in FIG. 5, a pressure spring 16*a* is used instead of the tension spring 16 depicted in FIG. 1. Between the preloading point 55 and the limit stop point 57 corresponding to the insertion position EP, the spring power increases essentially linearly. The position of the roller 17 can thereby be precisely controlled in the working region, or respectively, at the target working point 56 by the drive control 51 via the cooperation with the vacuum brake 13 and with the drive motor 41. In the insertion position, the spring power can be rendered ineffective in that the active connection between the roller 17 and the spring 16*a* is separated or the roller 17 is locked in a stationary fashion.

For stabilization of the motion of the paper web 6, the deflection rollers 14 and the moving roller 17 are of light weight constructed with a structured, soft surface. As FIG. 3 shows, these rollers comprise a light, mechanically stable roller core 49 consisting of plastic reinforced with carbon fibers (CFK). Soft plastic surfaces 48 are placed on this core 49 in an annular fashion. This effects the following: When the paper web 6 has the tendency to deviate from the target transport direction in a direction E, then the surfaces 48 deform into the position referenced 48*a* (shown as a dotted line). The soft surfaces 48 thereby effect a restoring counterforce conditioned by the deformation. The paper web 6 is thereby moved back into the initial position. The surfaces 48 can be foamed polyester urethane plastic, in particular.

Figures 5, 6:
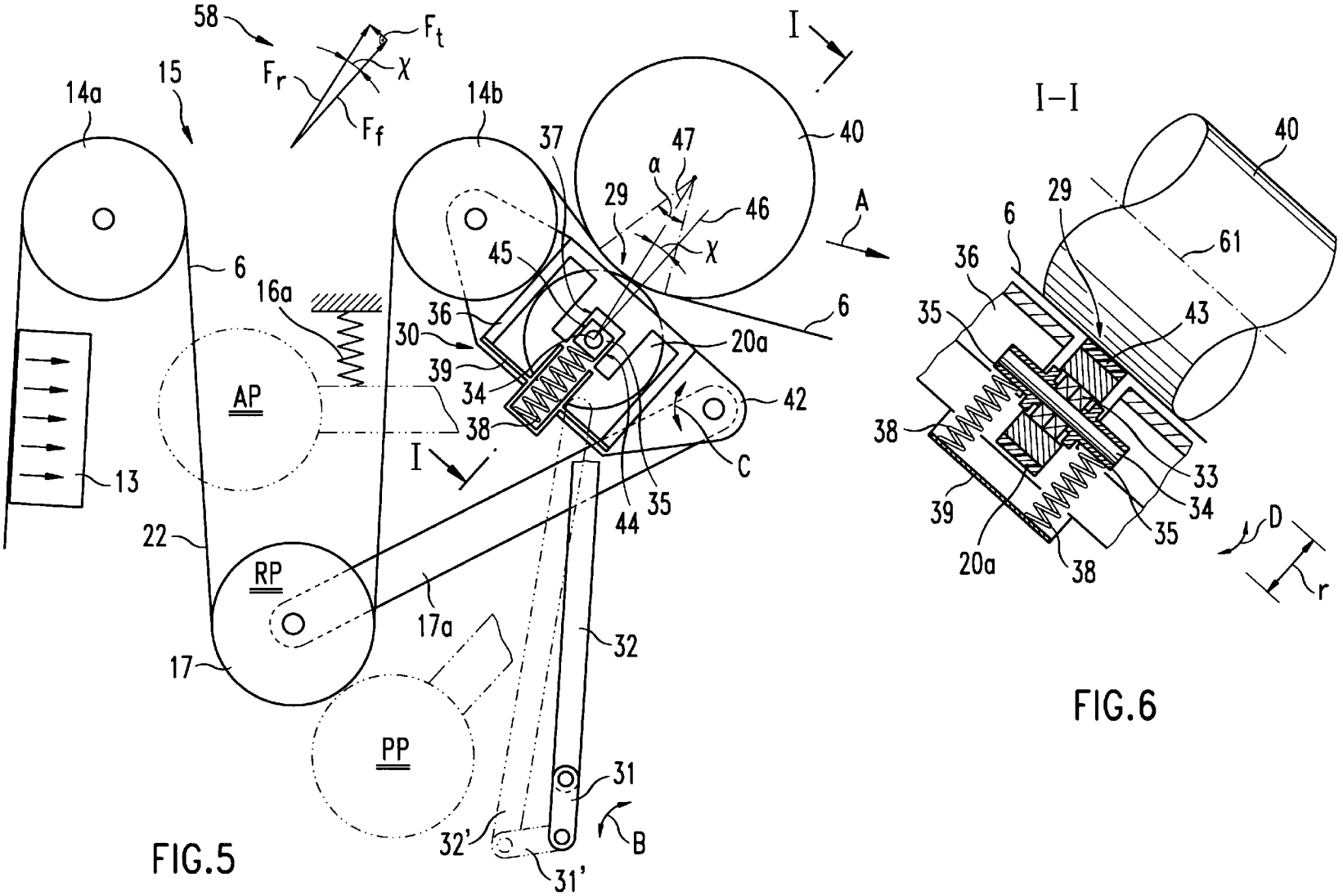
FIG. 5 is a schematic diagram showing details of a pressure apparatus in the paper transport.
FIG. 6 is a section along I—I of FIG. 5.

FIG. 5 depicts the input region of the drive assembly 25 in greater detail. At the output of the loop forming apparatus 15, a deflection roller 14*b* steers the recording medium web to the drive cylinder 40. The paper web 6 therein surrounds the drive cylinder 40 by an angle $\alpha$ of approximately 25°.

The paper web 6 is therein led between the drive cylinder 40 and the pressure cylinder 20*a*, whereby the pressure cylinder 20*a* exerts a pressing force on the recording medium, or respectively, the transport roller 40.

The pressure cylinder 20*a* is a component of a pressure unit 30 which is secured at the printer housing 18 with a fastening plate 42. The pressure unit 30 can be turned in or out in relation to the drive cylinder 40 via a coupling rod 32 by means of a crank 31 which can be swivelled in a direction B. In the out condition (31' and 32') a new paper web can be inserted; in the in condition the frictional conveyance can ensue. In the in-swivelling of the pressure unit 31 toward the transport roller 40, the pressure cylinder 20*a* displaces in a guide slot 37 of a carrier 36 against the pressure springs 38. The preloaded pressure springs 38 thereby exert a force $F_f$ on the paper web 6 via the pressure cylinder 20*a*. This force is transferred to the carrier 36 via a transverse carrier 39, and from there to the printer housing 18 via the fastening plate 42, the coupling bar 32 and the crank 31.

In the in condition, the pressure unit 30 is arranged relative to the drive cylinder 40 such that the pressure cylinder 20*a* is guided obliquely with respect to the drive cylinder 40. The axle 46 along which this is displaceable within the pressure unit 30, or respectively, along which the spring power $F_f$ acts, stands at an angle $\chi$ to the axle 47 on which the surface normal of the contact surface 29 between the drive cylinder 40 and the paper web 6, or respectively, the pressure cylinder 20 lies.

Within the guide slot 37, the bearing axle 34 of the drive cylinder 20*a* runs in a guide body 35 at a guide face 44 such that the direction of the spring power $F_f$ of the pressure spring 38 deviates by the angle $\chi$ from the axle 47 along which the pressing force $F_r$ acts. The pressure cylinder 20*a* is therein supported at the guide face 44 with the force $F_t$. As can be derived from the force diagram 58 (FIG. 5), the pressing force $F_f$ splits into a radial component $F_r$ which acts perpendicularly to the contact surface 29 and a second force component $F_t$ which acts perpendicularly to the guide axle 46. In the depicted exemplifying embodiment, the second force component $F_t$ acts to within a few degrees of the transport direction A of the paper web 6 in the region of the contact surface 29. This force component $F_t$ initially acts on the pressure cylinder 20*a* but is transferred via the axle 34 thereof and via the guide body 35 to the guide face 44 of the guide slot 37. The guide slot 44 receives this force and thereby supports the guide body 35, or respectively, the pressure cylinder 20*a*.

The following applies therein:

$F_f = F_r \cdot \cos\chi$ $F_t = F_r \cdot \sin\chi$.

The spring power $F_f$ is adapted to the drive control 51 such that in a withdrawal or a braking of the paper web 6 (following a print stoppage) the accelerating force effected on the paper web 6 by the drive 41 is smaller than the second force component $F_t$ which the spring 38 effects on the pressure cylinder 20. A lifting of the pressure cylinder 20 when the paper web 6 is withdrawn is thus prevented.

This arrangement permits a fitting of the guide body 35 inside the guide slot 37 with such great play that a gap forms between the guide slot 37 and the guide body 35 on the side of the guide slot 37 opposing the guide face 44. The slot 37 and the guide body 35 can therefore be favorably produced, since an exact fit between these two components is not necessary. The guide body 35 can be produced by means of a thermoplastic injection molded part, for example, while the guide slot 37 can be formed in a cost-effective extruded profile. The described arrangement is not merely highly tolerant of wear; moreover, the wear between these two components is slight.

The determination of the required spring power $F_f$ proceeds on the basis of a coefficient of sliding friction $\mu_{12}$ between drive cylinder 40 and the paper web 6. The value $\mu_{12}$ typically equals 0.2 to 0.3. For the radial force component $F_r$ between recording medium and drive cylinder 40 the following is then required:

$$F_r > \frac{F_{SZ}}{\mu_{12}}$$

whereby $F_{SZ}$ is the maximal force of the loop forming apparatus in the working region (cf. FIG. 2).

A dynamic force $F_{dyn}$ also acts on the pressure cylinder 20*a* via the acceleration of the paper web 6:

$$F_{dyn} = \frac{\theta_g \cdot \dot{\omega}}{r}$$

whereby $\theta_g$=mass moment of inertia of the pressure cylinder 20*a* about its rotational axle 34, $\dot{\omega}$=maximal angular acceleration of the drive cylinder 40 in the withdrawal motion and r=outer radius of the pressure cylinder 20*a*.

With the aid of the relations that may be derived from the force diagram 58

$F_t = F_r \sin\chi$, or respectively, $F_f = F_r \cos\chi$ the spring power $F_f$ of the pressure cylinder 38, the drive motor 41 and the drive control 51 are matched to one another in consideration of the constructionally prescribed angle $\chi$ such that the following applies:

$F_t > F_{dyn}$.

FIG. 6 shows a section through the pressure unit 30 and the drive cylinder 40 along the direction I—I of FIG. 5. The friction lining 43 of the pressure cylinder 20*a* consists of what is known as compact PUR elastomer (polyester urethane caoutchouc, Shore hardness 70 Sh A). This material guarantees a long lifetime for the pressure cylinders. The mounting axle 34 on which the pressure cylinder 20*a* is mounted by means of ball bearings 33 stands parallel to the axle 61 of the drive cylinder 40. The mounting of the pressure cylinder 20*a* therein permits a tilting motion along a direction D, so that under the effect of the pressing force of the pressure springs 38 the pressure cylinder 20*a* automatically orients toward the cylindrical outer surface of the drive cylinder 40.

Although the invention was described with the aid of particular exemplifying embodiments, it can be adapted in a variety of ways. For example, it can be provided to lead the axle of the pressure cylinder directly in a guide slot instead of via guide bodies. The surfaces 48 on the rollers 14 and 17 could contain pyramidal or elliptic structures, for example, in order to purposefully influence the restoring forces, or respectively, their stabilizing effect. The guide faces in the guide slot depicted in FIG. 5 can just as well be arranged on the other side with respect to the drive cylinder—i.e. before the drive cylinder—instead of in the transport direction—i.e. after the drive cylinder. In this case, the spring power and drive must be matched such that the pressure cylinder is not lifted from the guide face in an acceleration in the transport direction.

Although other modifications and changes may be suggested by those skilled in the art, it is the intention of the inventor to embody within the patent warranted hereon all changes and modifications as reasonably and properly come within the scope of their contribution to the art.

We claim:

1. An apparatus for the transport of a band-shaped recording medium in an electrographic punting or copying device, comprising:

a drive cylinder having a contact surface;

a drive connected to drive said drive cylinder;

a pressure cylinder displaceably mounted relative to said drive cylinder;

a guide face to guide displacement of said pressure cylinder;

a pressure spring effecting a contact pressure of said pressure cylinder on said drive cylinder;

the recording medium being transported between said drive cylinder and said pressure cylinder by friction, and said contact surface of said drive cylinder lying adjacent the recording medium; and said pressure spring being positioned so that its force effect is divided into a first radial force component acting perpendicularly to the contact surface and a second force component received by said guide face so that the recording medium can be repositioned for restarting of printing following a halting of printing;

said guide face defining a guide slot in which is mounted said pressure roller for guided movement, said guide slot having a guide axis at an acute angle to the contact surface.

2. An apparatus according to claim 1, wherein said second force portion acts in a transport direction of the recording medium.

3. An apparatus according to claim 1, wherein said pressure spring and said drive for said drive cylinder are matched such that in a withdrawal direction of the recording medium opposite the transport direction the second force portion is greater than a frictional force acting on said pressure cylinder from the recording medium.

4. An apparatus according to claim 1, wherein the force direction of said pressure spring forms an acute angle $\chi$ with a connecting line between said drive cylinder and said pressure cylinder.

5. An apparatus as claimed in claim 4, wherein said angle $\chi$ is approximately 25 degrees.

6. An apparatus as claimed in claim 4, wherein said acute angle is approximately 25 degrees.

7. An apparatus according to the claim 3, further comprising:

a first loop forming apparatus with a loop draw spring, the force direction of said pressure spring forms an acute angle $\chi$ with a connecting line between said drive cylinder and said pressure cylinder, and spring force $F_f$ of the pressure spring and said drive are matched with one another such that the following applies:

$F_r > F_{dyn}$, whereby $F_t = F_r \sin\chi$, $F_f = F_r \cos\chi$, $$F_r > \frac{F_{SZ}}{\mu_{12}}$$

$$F_{dyn} = \frac{\theta_g \cdot \dot{\omega}}{r}$$

$F_{SZ}$=maximal force of the loop draw spring, $\mu_{12}$=coefficient of sliding friction between said drive cylinder and the recording medium, $\theta_g$=mass moment of inertia of said pressure cylinder about its rotational axle, $\dot{\omega}$=maximal angular acceleration of said drive cylinder in the withdrawal motion and r=outer radius of said pressure roller.

8. An apparatus according to claim 1, further comprising:

a guide body bearing a rotational axle of said pressure shaft positioned in said guide slot, said guide body being narrower than said guide slot, said guide body abutting said guide face.

9. An apparatus according to claim 1, wherein said pressure cylinder comprises a plurality of pressure rollers which press against said drive cylinder along the axis thereof.

10. An apparatus for the transport of a band-shaped recording medium in an electographic printing or copying device, comprising:

a drive cylinder having a contact surface;

a drive connected to drive said drive cylinder;

a pressure cylinder displaceably mounted relative to said drive cylinder;

a guide face to guide displacement of said pressure cylinder;

a pressure spring effecting a contact pressure of said pressure cylinder on said drive cylinder;

the recording medium being transported between said drive cylinder and said pressure cylinder by friction, and said contact surface of said drive cylinder lying adjacent the recording medium;

said first pressure spring being positioned so that its force effect is divided into a first radial force component acting perpendicularly to the contact surface and a second force component received by said guide face so that the recording medium can be repositioned for restarting of printing following a halting of printing; and a second pressure spring provided per said pressure cylinder, said first and second pressure springs acting symmetrically on said pressure roller via a bearing axle.

11. An apparatus for the transport of a band-shaped recording medium in an electrographic printing or copying device, comprising:

a drive cylinder having a contact surface;

a drive connected to drive said drive cylinder;

a pressure cylinder displaceably mounted relative to said drive cylinder;

a guide face to guide displacement of said pressure cylinder;

a pressure spring effecting a contact pressure of said pressure cylinder on said drive cylinder;

the recording medium being transported between said drive cylinder and said pressure cylinder by friction, and said contact surface of said drive cylinder lying adjacent the recording medium; and said pressure spring being positioned so that its force effect is divided into a first radial force component acting perpendicularly to the contact surface and a second force component received by said guide face downstream relative to the transport direction;

said guide face defining a guide slot in which is mounted said pressure roller for guided movement, said guide slot having a guide axis at an acute angle to the contact surface.

* * * * *